United States Patent [19]

Rhetts

[11] Patent Number: 4,795,162

[45] Date of Patent: Jan. 3, 1989

[54] FOLDABLE BINGO SHEET HOLDER

[76] Inventor: Carl Rhetts, P.O. Box 1015, H. Beach, Calif. 92647

[21] Appl. No.: 85,387

[22] Filed: Oct. 8, 1987

[51] Int. Cl.[4] ..... A63F 3/06

[52] U.S. Cl. ..... 273/309; 248/451; 248/460

[58] Field of Search ..... 273/148 R, 148 A, 269, 273/240, 309, 285; 248/451, 460, 461

[56] References Cited

U.S. PATENT DOCUMENTS 4,502,658 3/1985 Wirt et al. ..... 273/148 A X 4,555,084 11/1985 Anderson et al. ..... 273/269 X

*Primary Examiner*—Anton O. Oechsle

[57] ABSTRACT

A foldable bingo board with four round feet which close inside opposing holes in board, allowing it to fold flat and be carried or stored easily.

6 Claims, 1 Drawing Sheet

FIG. 1
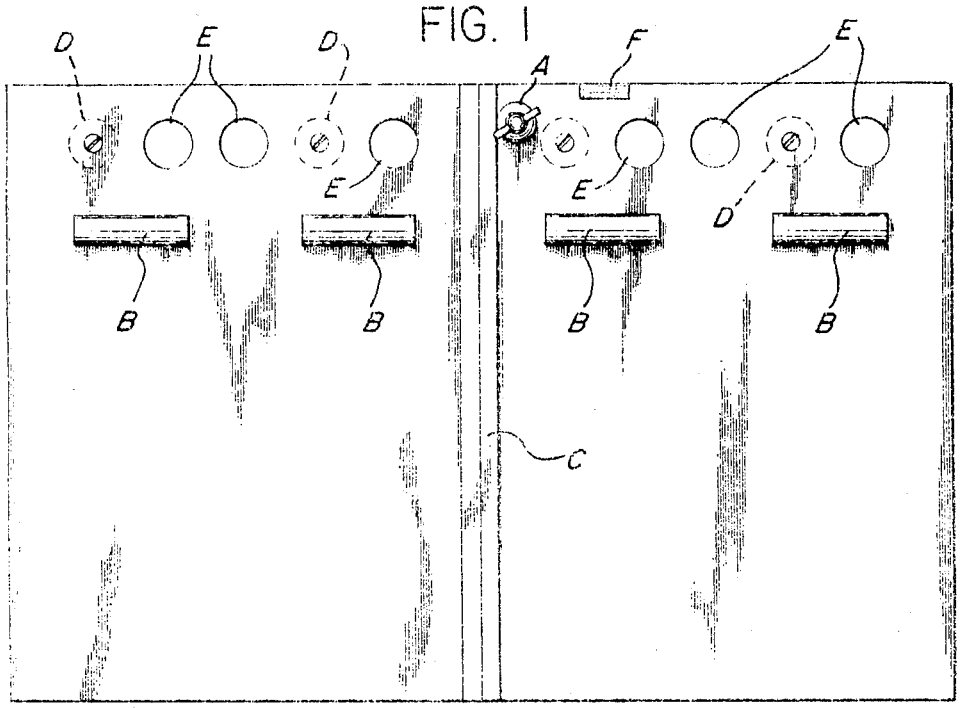
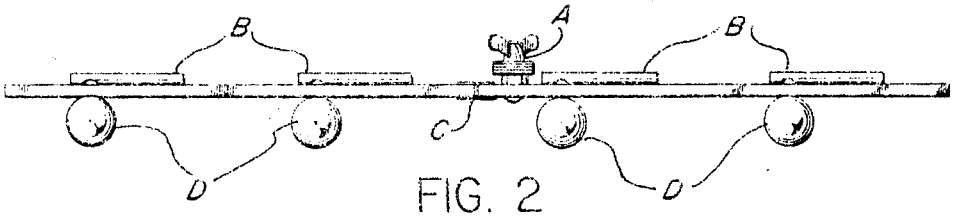
FIG. 2
FIG. 3
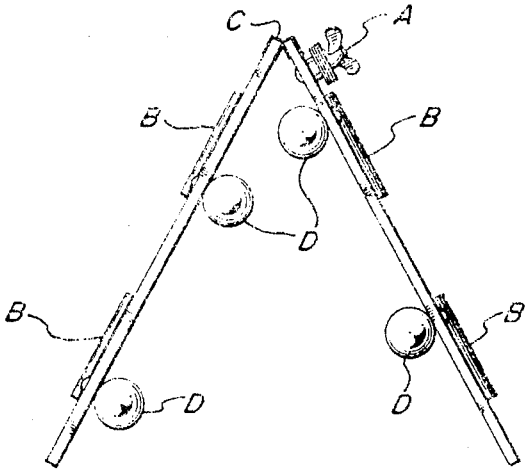
FIG. 4
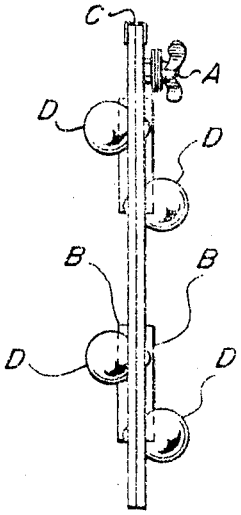

FOLDABLE BINGO SHEET HOLDER

BACKGROUND OF THE INVENTION

A Bingo Board that can be folded in half is needed to allow player to place three bingo sheets across under spring clips, with holes for ink dauber bottles, and also serve as holes for feet to close over.

SUMMARY OF THE INVENTION

The Bingo FoldaBoard has four round feet; two on each half of board for slight playing angle, having opposing holes slightly larger on the other half which feet close inside, allowing the board to close flat. The holes also serve as holders for ink Dauber bottles. Poker chips are centered drilled and placed over bolt with wingnut to hold chips when not playing. Magnetic strip is to hold wingnut on board while playing. Four standard clips to hold bingo sheets (clipboard type), clips optional.

DESCRIPTION OF THE DRAWINGS

FIG. 1 is a front elevational view of Bingo FoldaBoard fully open;

FIG. 2 is a top plan view fully opened;

FIG. 3 is a top plan view partially closed;

FIG. 4 is a top plan view fully closed.

DESCRIPTION OF THE PREFERRED EMBODIMENT

The two MASONITE boards (⅛" thick) referred to generally in FIG. 1 are joined by a fibre reinforced tape c, acting as a simple hinge. Four standard type spring clips (clip board type) are used to hold bingo sheets. The round wooden feet referred to in FIG. 3 are placed opposite holes: 1½" allowing feet: 1¼", to close through hole and board closing flat referred to in FIG. 4. A poker chip spindle: (bolt and wingnut) is referred to in FIG. 2-*a*, used to hold center drilled chips, and FIG. 1*f* depicts magnetic strip to hold the wingnut on board while playing Bingo.

I claim:

1. A bingo sheet holder comprising two panels hingedly attached at adjoining edges for movement between an open operative position wherein the panels are coplanar for supporting a plurality of bingo sheets and a closed storage position wherein the panels are superimposed, a plurality of generally spherical foot elements attached to each of said panels adjacent edges thereof which are colinear when the panels are in their open position, at least a corresponding plurality of apertures in each of said panels selected ones of which are sized and positioned to receive correspondingly positioned foot elements of the other of said panels when the panels are in their closed position hereby enabling said holder to be folded to a compact condition.

2. A bingo sheet holder as defined in claimed 1 further comprising means to hold a plurality of bingo sheets on the holder.

3. A bingo sheet holder as defined in claim 2 wherein said housing means comprises clips in each of said panels on the side thereof opposite said foot elements.

4. A bingo sheet holder as defined in claim 1 further comprising a chip holder on one of said panels on a side thereof opposite said foot elements.

5. A bingo sheet holder as defined in claim 4 wherein said clip holder is in the form of a spindle for receiving center drilled chips and a wing nut for disposition on said spindle in overlaying relationship to chips disposed in the spindle.

6. A bingo sheet holder as defined in claim 1 wherein said apertures are sized to hold ink dauber bottles.

* * * * *